US008734301B2

(12) United States Patent
Remelius

(10) Patent No.: US 8,734,301 B2
(45) Date of Patent: May 27, 2014

(54) PARTICULATE MATERIAL TREADMILL

(76) Inventor: Jebb G. Remelius, Leverett, MA (US)

( * ) Notice: Subject to any disclaimer, the term of this patent is extended or adjusted under 35 U.S.C. 154(b) by 351 days.

(21) Appl. No.: 13/343,047

(22) Filed: Jan. 4, 2012

(65) Prior Publication Data

US 2012/0178591 A1 Jul. 12, 2012

Related U.S. Application Data

(60) Provisional application No. 61/460,783, filed on Jan. 6, 2011.

(51) Int. Cl.
*A63B 22/02* (2006.01)

(52) U.S. Cl.
USPC ..... 482/54; 198/388

(58) Field of Classification Search
USPC ..... 482/51, 54
See application file for complete search history.

(56) References Cited

U.S. PATENT DOCUMENTS

| | | | | |
|---|---|---|---|---|
| 4,674,622 | A * | 6/1987 | Utsunomiya et al. | 198/500 |
| 5,205,800 | A | 4/1993 | Grant | |
| 5,993,358 | A | 11/1999 | Gureghian et al. | |
| 6,716,106 | B2 | 4/2004 | Wang et al. | |
| 6,821,230 | B2 | 11/2004 | Dalebout et al. | |
| 7,510,511 | B2 | 3/2009 | von Detten | |
| 7,862,478 | B2 | 1/2011 | Watterson et al. | |
| 7,976,437 | B1 * | 7/2011 | Von Detten | 482/54 |
| 8,012,068 | B1 * | 9/2011 | Malcolm | 482/54 |
| 2004/0192511 | A1 * | 9/2004 | Ein-Gal | 482/54 |
| 2005/0245359 | A1 * | 11/2005 | Lo | 482/54 |
| 2007/0060451 | A1 | 3/2007 | Lucas | |
| 2008/0176719 | A1 | 7/2008 | To | |
| 2012/0021875 | A1 | 1/2012 | Karl | |
| 2013/0178340 | A1 * | 7/2013 | AL Kuwari et al. | 482/54 |
| 2013/0225369 | A1 * | 8/2013 | Fisbein et al. | 482/1 |
| 2013/0281241 | A1 * | 10/2013 | Watterson et al. | 474/268 |

FOREIGN PATENT DOCUMENTS

DE 102009019482 11/2010

OTHER PUBLICATIONS

Davies et al, The energetics of walking on sand and grass at various speeds, Ergonomics, Jun. 10, 2006, pp. 651-660, vol. 49, No. 7.
Pinnington et al, The Energy Cost of Running on Grass Compared to Soft Dry Beach Sand, Journal of Science and Medicine in Sport, 2001, 4(4), pp. 416-430.
Walking on Infinite Grass, Filmed at CSAW Gallery 2006, You Tube video uploaded by Effuse1, Sep. 4, 2007, http://www.youtube.com/watch?v=CLH2k_q1xE8&feature=player_embedded.

* cited by examiner

*Primary Examiner* — Stephen Crow
(74) *Attorney, Agent, or Firm* — Grossman Tucker Perreault & Pfleger PLLC

(57) ABSTRACT

An apparatus for providing a walking surface including a particulate material to a user is described. In some embodiments, the apparatus includes a primary endless belt that transports a walking surface formed at least in part by a particulate material. The apparatus may further include a return transport system to facilitate recycling of the particulate material to the front of the apparatus. Methods of exercise and methods of treatment using such an apparatus are also described.

20 Claims, 13 Drawing Sheets

Top View

Cross Sectional
View

Side view

Top View

Side View

Perspective View

PARTICULATE MATERIAL TREADMILL

This application claims the benefit of U.S. Provisional Application No. 61/460,783, filed Jan. 6, 2011, the entire content of which is incorporated herein by reference.

BACKGROUND

Exercise treadmills are common and available in a variety of configurations. They may be used to perform a number of different exercises, such as aerobics, walking, running, and the like, with the user remaining in a relatively stationary position. Treadmills may also be used for therapy and diagnostic purposes such as cardiovascular stress testing, physical therapy, gait analysis, and the like.

Traditional treadmills generally include single endless belt that is extended between and movable about a pair of rollers. The endless belt may be driven in a motorized fashion, for example by using a roller encircled by an endless chain loop that engages a pinion gear mounted to an axle of a motor drive shaft, which in turn engages a drive sprocket mounted to an axle shaft of at least one of the rollers.

The endless belt of a traditional treadmill is often formed by a rubber material that is sturdy and which has sufficient tensile strength to withstand the forces produced by a user exercising on the treadmill. The endless belt is also often supported along its length and width between the rollers so as to enable the belt to bear the weight of a user. For example, a plurality of support pins or a decking system may be placed contiguous with an underside of the endless belt in order to provide appropriate support.

Typically, the walking surface of the endless belt has a smooth and non-textured finish that is designed to simulate certain a flat and relatively hard surface, such as asphalt or the loop of a track and field stadium. As such, traditional treadmills are unable to leverage the advantages of walking on certain natural surfaces (e.g., sand), which have been shown to increase the energetic cost of walking and running at all speeds.

In addition, the walking surface of a traditional treadmill is relatively hard and non-compliant. As a result, the impact forces generated by a user while exercising on such a treadmill may be substantial. Over time, such impact forces can cause wear and tear on the body, particularly the joints of the lower body. This can limit or prevent some users from exercising on a traditional treadmill. For example, individuals who are injured or who have a chronic condition such as lower back pain or diabetic neuropathy may not be able to tolerate the impact forces generated during exercise on a traditional treadmill.

Traditional treadmills may also be of limited usefulness in physical conditioning and/or rehabilitation programs for certain individuals, such as the elderly, the handicapped, and the obese. Such individuals frequently have limited mobility, and may not be able walk or run on a traditional treadmill at a sufficient rate for weight loss, physical therapy, or another purpose. Moreover, such users often suffer from joint problems and other injuries, which can independently limit the usefulness of a traditional treadmill, as described above.

SUMMARY

One aspect of the present disclosure relates to an apparatus that includes at least two rollers, and a primary endless belt rotatably disposed about the at least two rollers. The primary endless belt includes a primary endless belt surface, a primary endless belt rear end, and a primary endless belt front end. In some embodiments, a walking surface including a layer of particulate materials is disposed on the primary endless belt surface. The apparatus further includes a return transport system that is operable to receive the particulate material of the walking surface at a position proximate to the primary endless belt rear end, and to deliver the particulate material to the primary endless belt surface at a position proximate to the primary endless belt front end. In some embodiments, the apparatus is a treadmill, such as but not limited to an exercise treadmill.

Methods of using the apparatus described herein are also disclosed. In some embodiments, such methods include exercising an animal using the apparatus (e.g., a treadmill) disclosed herein.

Additional objects and advantages of the present disclosure will be set forth in part in the description which follows, and in part will be obvious from the description, or may be learned by practice of the present disclosure. The objects and advantages of the present disclosure will be realized and attained by means of the elements and combinations particularly pointed out in the appended claims.

While the accompanying drawings illustrate and the following specification describes certain preferred embodiments of the present disclosure, it should be understood that such description is by way of example only. There is no intent to limit the principles of the present disclosure to the particular disclosed embodiments. References hereinafter made to certain directions, such as, for example, "front", "back", "top", "bottom", "left" and "right", are made as viewed from the rear of devices according to the present disclosure looking forward.

DETAILED DESCRIPTION

Reference will now be made in detail to exemplary embodiments of the present disclosure, examples of which are illustrated in the accompanying drawings. Wherever possible, the same reference numbers will be used throughout the drawings to refer to the same or like parts.

As used herein, the terms "substantially," and "about," when used in the context of an amount, mean+/−5% of the stated amount.

As used herein, the term "walking surface" means a surface that is disposed on a surface of a rotatable endless belt, and which is intended for contact with the extremities (hands, feet, paws, hooves, etc.) of a user of the apparatus disclosed herein. In the context of a treadmill apparatus intended for human use, for example, a walking surface would correlate to the surface that contacts (e.g., is in direct contact with) the feet of a user exercising on the apparatus. It should be understood that the walking surfaces described herein are useful not only for walking, but also for other forms of exercise. Indeed, a user may walk, run, skip, jump, or otherwise move on the walking surfaces of the present disclosure. In some embodiments, a user may move on the walking surfaces described herein while his/her body is at least partially supported, e.g., by a partial body weight support system.

One aspect of the present disclosure relates to an apparatus comprising at least one rotatable endless belt having a walking surface disposed thereon, wherein the walking surface is formed at least in part by one or more particulate materials. In some embodiments, the walking surface includes a layer of particulate material, the height, distribution and/or temperature of which may be controlled through a variety of mechanisms.

Figure 1:
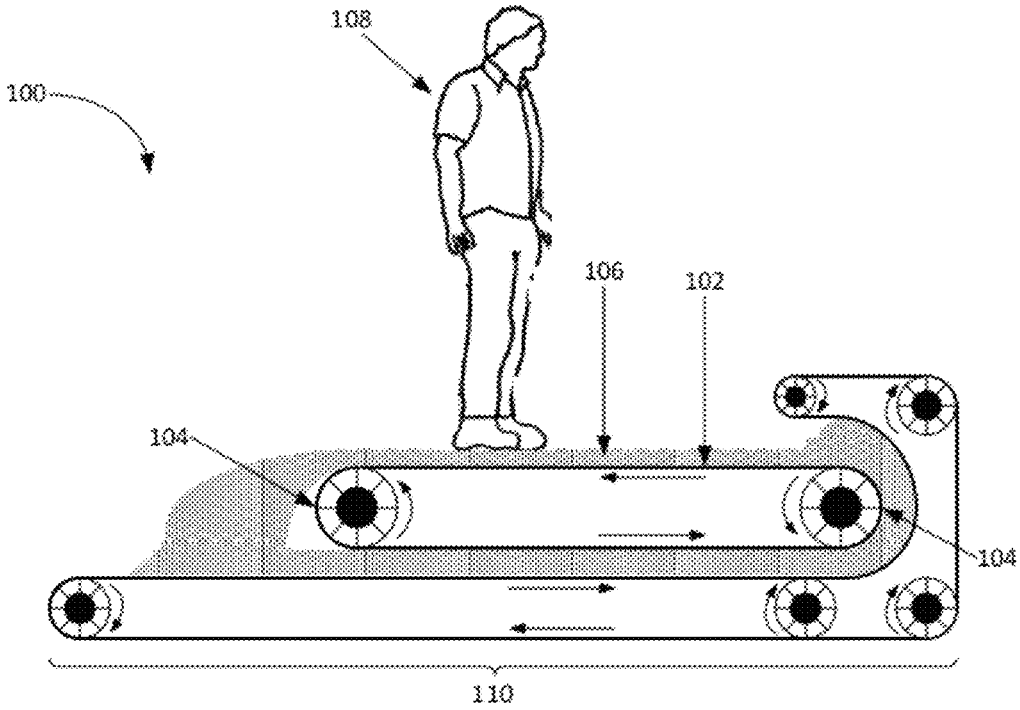
FIG. 1 is a side view of apparatus including a primary endless belt consistent with non-limiting embodiments of the present disclosure.

As a non-limiting example of an apparatus according to the present disclosure, reference is made to FIG. 1. FIG. 1 depicts apparatus 100 (e.g. a treadmill) including a primary endless belt 102 that is disposed around at least one head and tail roller (collectively, rollers 104). In operation, one or more of rollers 104 may be driven in a motorized fashion, thereby causing primary endless belt 102 to rotate. Accordingly, primary endless belt 102 is "rotatably disposed" around rollers 104.

As shown, walking surface 106 is present on an upward facing surface of primary endless belt 102. As primary endless belt 102 rotates, walking surface 106 (which may be or include a layer of particulate material, as described below) may be continuously conveyed from a front of primary endless belt 102 to a rear of primary endless belt 102. In other words, walking surface 106 may be conveyed from a position in front of user 108 of apparatus 100 to a position behind user 108 of apparatus 100. As such, user 108 may move (e.g., walk, run, skip, etc.) on walking surface 106, while remaining in a relatively stationary position.

Walking surface 106 may be formed at least in part by particulate materials. As non-limiting examples of such particulate materials, mention is made of sand (e.g., silica), quartz, limestone, polymer (e.g., polystyrene, polyolefin, polyester, polyamide etc.), rock, metal, rubber, and combinations thereof. In some embodiments, the particulate material is sand.

The average particle size of the particulate material of walking surface 106 may vary widely. In some embodiments, the average particle size of the particulate material is large enough to avoid dusting of the particulate material as walking surface 106 is transported by primary endless belt 102, particularly as a user 108 moves on apparatus 100. Additionally or alternatively, the average particle size of the particulate material may be small enough to facilitate recycling of the material by a return transport mechanism, such as return transport system 110 (described later). As non-limiting examples of suitable average particle size ranges that may be used, mention is made of about 25 to 2000 microns, about 100 to about 1500 microns, about 150 to about 1500 microns, about 100 to about 1000 microns, about 100 to about 500 microns or even about 200 to about 500 microns.

The depth of the layer of particulate material may vary widely. For example, the layer of particulate material may have a having a depth ranging from about one-half inch to about 12 inches or more. In some embodiments, walking surface 106 is formed by a layer of particulate material having a depth ranging from about 1 to about 10 inches, such as about 2 to about 8 inches, about 3 to about 7 inches, about 4 to about 6 inches, or even about 5 inches. Of course, depths above, below, and within the aforementioned ranges can be used, and are envisioned by the present disclosure. In some embodiments, walking surface 106 is formed by a layer of particulate material having a depth of about 3 inches.

In instances where walking surface 106 includes or is formed by a layer of particulate material, the depth and distribution of the layer of particulate material across the length and width of walking surface 106 may be uniform, or it may vary. More specifically, the depth and distribution of the layer of particulate material may be uniform across one or both of the width of walking surface 106 and the length of walking surface 106, or it may vary across one or more of those dimensions. In some embodiments, the walking surface 106 may include or be formed by a layer of particulate material having a uniform depth, e.g., of about 0.5, 1, 2, 3, 4, 5, 6, 7, 8, 9, 10, 11, or 12 inches, or more. In one non-limiting embodiment, walking surface 106 is formed by a layer of particulate material having a substantially uniform depth of about 3.5 inches.

In further non-limiting embodiments, walking surface 106 includes or is formed by a layer of particulate material having a depth that varies in a length and/or width dimension of walking surface 106. For example, the depth of the layer of particulate material may vary between a first depth and a second depth, either periodically or in a random pattern. In this way, the treadmill device described herein can simulate the experience of walking and/or running on a natural surface, such as but not limited to a sand beach. Accordingly, the depth of walking surface 106 may vary periodically, randomly, and/or pseudo-randomly between a first depth ranging from about 0.5 to about 12 inches, to a second depth ranging from about 0.5 to about 12 inches. In some embodiments, the first depth ranges from about 1 to about 8 inches, and the second depth ranges from about 1 to about 8 inches. And in additional non-limiting embodiments, the first depth may range from about 1 to about 3 inches, and the second depth ranges from about 6 to about 9 inches.

For example, the systems and methods of the present disclosure may emply a walking surface having an uneven surface that is configured to simulate the appearance and or feel of natural terrain, such as a sand beach. The walking surfaces described herein may therefore be of varying height to simulate the appearance of wind driven sand. In such instances, the undulations of the walking surface may include ridge ripples. Such ridge ripples may be perpendicular to an edge of the walking surface, parallel to an edge of the walking surface, at an angle from an edge the walking surface, or a combination thereof. Moreover, the height of the walking surface may vary, e.g., in a sinusoidal pattern. As may be appreciated, the systems and methods described herein can set the amplitude (height) of the sinusoidal pattern, as well as the period (time between peaks) in such a pattern.

The depth of the layer of particulate material can impact the workload (and hence, energy expenditure) of a user exercising on the walking surface of the apparatus described herein. For example, increasing the particulate material depth can increase the workload on the user, resulting in higher energy expenditure, and vice versa. In this way, the workload imposed on a user exercising on the walking surfaces described herein can be adjusted independently of or in conjunction with adjustments to walking speed, i.e., the rate at which walking surface 106 is transported from the front of apparatus 100 to the rear of apparatus 100. Further, by varying the depth and/or distribution of the particulate material layer across the dimensions of the walking surface, it is possible to stress different parts of the body of a user exercising on the walking surfaces described herein. This can open numerous avenues to new methods of exercising and rehabilitating targeted areas of the body.

One or more of the type, depth, and distribution of particulate material may be selected so as to provide impact dissipating properties to walking surface 106. In instances where a high degree of cushioning is desired, for example, it may be desirable to select a particulate material, layer depth, and/or layer distribution that provides an enhanced level of impact dissipation. For example, a walking surface that is formed by a free flowing particulate material of significant depth (e.g., 6-8 inches or more) and small particle size may be able to more widely distribute the forces imposed by a user's foot, relative to a walking surface that is thinner and made of a particulate material that is not free flowing or which is of a larger particle size. Accordingly, the properties of walking surface 106 may be adjusted such that the impact forces conveyed to a user 108 of apparatus 100 are maintained at a desired level. Apparatus 100 may therefore be used in various therapeutic applications such as physical therapy, where management of the cumulative impact loading of the knee, hip joints and other joints may be important.

The moisture content of the walking surface may also be controlled. In some embodiments, the walking surface may have a posture level ranging from about 0 to about 99%, such as about 5 to about 50%, or even about 20 to about 30%. Moisture content may also be reported in terms of relative humidity. Accordingly, the walking surfaces described herein may have a relative humidity at 25° C. ranging from 0% to about 100%, such as about 5 to about 50%, or even about 20 to about 30%. Of course, such ranges are exemplary only, and other moisture levels may be used.

As noted above, walking surface 106 may be continuously conveyed from a front of apparatus 100 to a rear of apparatus 100 by primary endless belt 102. When walking surface 106 reaches a rear end of apparatus 100 (or more specifically, of primary endless belt 102), all or a portion of its particulate material may fall from primary endless belt 102 and disintegrate. While the present disclosure envisions embodiments of apparatus 100 wherein the particulate material 106 is continuously provided from an external source, in non-limiting preferred embodiments a mechanism is provided to return the particulate material of walking surface 106 to the front of apparatus 100 or, more specifically, to the front of primary endless belt 102.

In this regard, further reference is made to FIG. 1, which illustrates a non-limiting example of apparatus 100 that includes return transport system 110. Generally, return transport system 110 operates to receive the particulate material of walking surface 106 at a position proximate to the rear of primary endless belt 102, and to deliver the received particulate material to a position proximate to a front end of apparatus 100. At that point, the particulate material may be delivered to an upward facing surface of primary endless belt 102, either by return transport system 110 or by another suitable mechanism. Once the particulate material has been delivered to the upward facing surface of primary endless belt 102, it may be reconstituted into walking surface 106 and again presented to user 108 of apparatus 100. In this way, the particulate material of walking surface 106 may be cycled in a continuous loop fashion from an upward facing surface of endless belt 102 at a position proximate to the front of apparatus 100, to the rear of apparatus 100, to return transport system 110, and back to an upward facing surface of primary endless belt 102 at a position proximate to the front of apparatus 100.

It should be understood that in the context of the present disclosure, the term "proximate" is used to refer to a relative position along the apparatus disclosed herein, and not to an extremity. Thus, for example, "proximate to a rear end of apparatus 100" refers to a position that is closer to the rear end of apparatus 100 than the front end of apparatus 100.

The present disclosure will now focus on more detailed aspects of the various components of the present disclosure, beginning with the nature and configuration of the primary endless belt. Following that discussion, the present disclosure will describe the return transport system and various other features that may be included in the apparatus described herein.

As explained previously, the apparatus of the present disclosure can include a primary endless belt, such as primary endless belt 102 shown in FIG. 1. At least a portion of the primary endless belt can provide support to the walking surfaces described herein. For example, the primary endless belt may include at least one upward facing surface upon which a walking surface is disposed. As the primary endless belt rotates, the walking surface disposed thereon may be presented to a user who is walking or otherwise exercising on the apparatus. As such, in addition to providing support for the walking surfaces described herein, primary endless belt 102 may also be configured to support the weight of a user exercising on the walking surface. To facilitate this support, primary endless belt 102 may be supported, e.g., by a decking or other support system known in the art (not shown).

Figure 2:
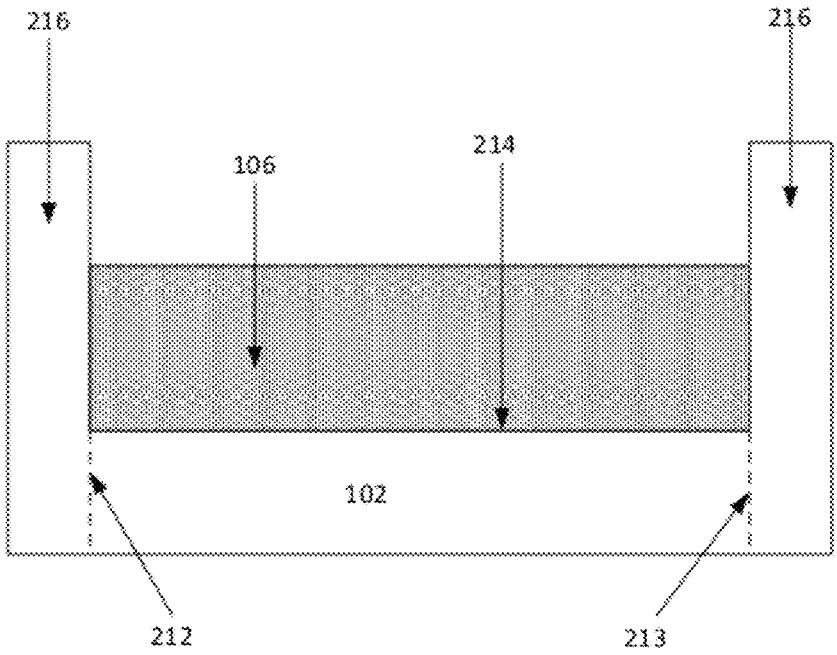
FIG. 2 is a cross sectional view of a primary endless belt including integral sidewalls in accordance with non-limiting embodiments of the present disclosure.

As one non-limiting example of a primary endless belt in accordance with the present disclosure, reference is made to FIG. 2. As shown, primary endless belt 102 includes two lateral edges 212, 213, and an upward facing surface 214. Upward facing surface 214 defines an area upon which walking surface 106 is disposed.

The primary endless belt may be driven around a set of rollers by any means. In some embodiments, the primary endless belt is motor-driven around a head roller and tail roller, which may be located proximate to the front end and the rear end of the apparatus, respectively. The primary endless belt can rotatably move about the head roller and tail roller at any desired speed. For example, the speed of the primary endless belt may range from 0 to about 5 m/s, such as from greater than 0 to about 4.5 m/s, or even from about 0.5 to about 3.5 m/s. Of course, other set points and ranges are possible, and are envisioned by the present disclosure.

As a user moves on the walking surface, individual grains of the particulate material of the walking surface may stray from the periphery of the primary endless belt. If not contained, such particles may become lodged in moving parts of the apparatus, thus hindering its operation. Thus, in some embodiments of the present disclosure, the apparatus described herein includes structures designed to contain the particulate material to upward facing surface 214 as primary endless belt 102 rotates. As non-limiting examples of such structures, mention is made of sidewalls that are disposed at, on, or adjacent to the lateral edges of primary endless belt 102. By virtue of their height and proximity to the lateral edges of primary belt 102, such sidewalls may prevent or limit the escape of particulate material from the primary endless belt. And in some embodiments, such sidewalls may facilitate the maintenance of a substantially constant walking surface by applying a lateral force to the peripheral area of primary endless belt 102, which may prevent the outer lateral regions of walking surface 106 from sloping downward.

In some embodiments, the apparatus of the present disclosure includes sidewalls that are coupled to a stationary portion of apparatus, such as a support structure underlying primary endless belt 102. In such embodiments, the sidewalls may remain stationary during the rotation of primary endless belt 102. In those instances, such sidewalls may be integral with the support structure, i.e., formed as a single piece with the support structure. Of course, such integral/unitary construction is not necessary, and the sidewalls may be coupled to a stationary portion of the apparatus by a suitable fastener.

Alternatively, the sidewalls may be mobile and may circumnavigate the apparatus in a manner that mirrors the motion of the primary endless belt. In such non-limiting embodiments, the sidewalls may be integral with the lateral edges the primary endless belt. This concept is illustrated in FIG. 2, wherein integral sidewalls 216 are integrally formed with lateral edges 212, 213 of primary endless belt 102. That is, integral sidewalls 216 and lateral edges 212, 213 are formed as a single piece. In some embodiments, integral sidewalls 216 and lateral edges 212, 213 are formed as a single piece throughout the length of primary endless belt 102.

Figure 3A:
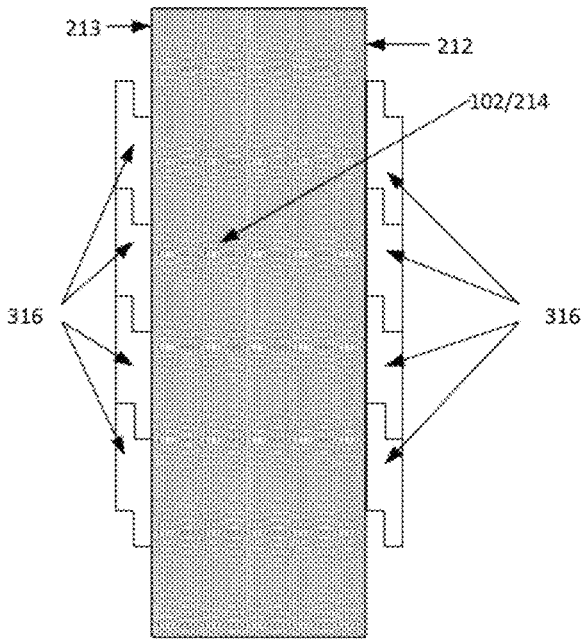
FIGS. 3A and 3B are top and side views, respectively, of a primary endless belt including interlocking sidewalls in accordance with non-limiting embodiments of the present disclosure.
Figure 3B:
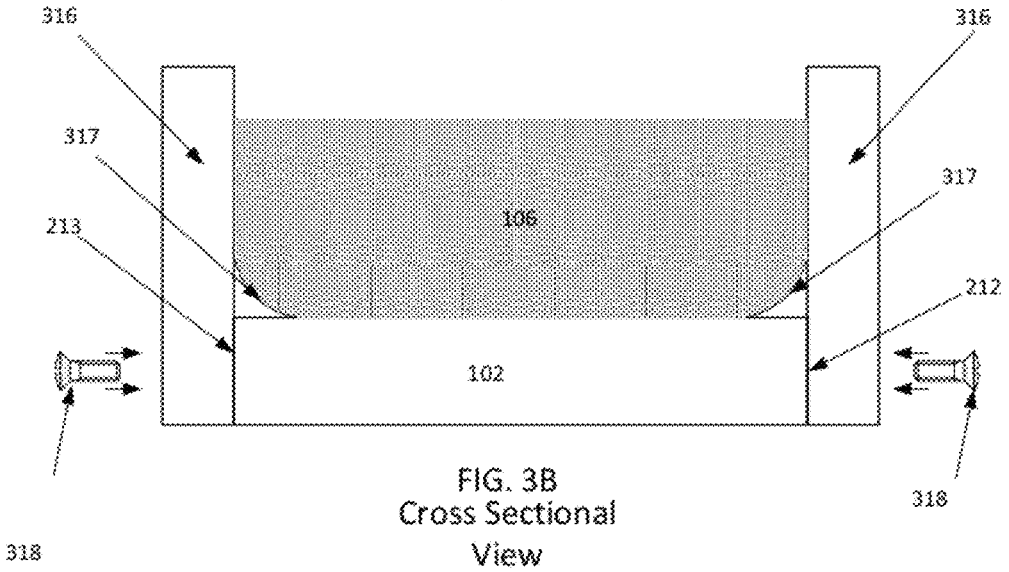

In other non-limiting embodiments, the sidewalls of the primary endless belt may be constructed from individual interlocking sidewall elements. This concept is illustrated in FIGS. 3A and 3B, wherein lateral edges 212, 213 of primary endless belt 102 are coupled to a plurality of interlocking sidewall elements 316. As shown, interlocking sidewall elements 316 are disposed along a lateral edge of primary endless belt 102. Each individual interlocking sidewall element 316 may be coupled to adjacent interlocking sidewall elements (e.g., via a butt or lap joint), thereby forming a substantially continuous sidewall along the upward facing surface 214 of primary endless belt 102. Unlike integral sidewalls 216, each interlocking sidewall 316 may be attached to primary endless belt 102 via one or more fasteners (e.g. glue, a screw, a hinge, a nail, a rivet, etc.), a carpentry joint (e.g., a lap or butt joint) or a combination thereof. As shown in the non-limiting example in FIG. 3B, interlocking sidewalls 316 are attached to lateral edges 212, 213 of primary endless belt 102 via a fastener 318, i.e., a screw.

To prevent leakage of particulate material, a particulate-containment mechanism may be provided the joint between the primary endless belt and the elements of an interlocking sidewall. For example, a particulate impervious membrane may be bonded or otherwise coupled between the primary endless belt and an element of the interlocking sidewall. This concept is illustrated in FIG. 3B, wherein membrane 317 is disposed at the point of attachment between interlocking sidewall elements 316 and lateral edge 212, 213 of primary endless belt 102. In some embodiments, membrane 317 stretches to provide a particulate impervious barrier at the point of attachment between interlocking sidewall element 316 and a lateral edge of primary endless belt 102.

Membrane 317 may be connected to a lateral edge of the primary endless belt and the sidewalls by one or more fasteners. Non-limiting examples of such fasteners include glue, rivet, a nail, a screw, or any other fastening means capable of affixing the attachment to the sidewalls and the primary endless belt. In some embodiments no fastener is necessary, as the attachment may, for example, be heat bonded to the side walls and primary endless belt.

Regardless of their nature, the height of the sidewalls of the primary endless belt preferably exceeds the maximum height of the particulate material of the walking surface. In this way, the sidewalls may act as a barrier to limit or prevent particulate material from spilling over the lateral edges of the primary endless belt while as user walks or otherwise exercises on the walking surface. This concept is illustrated in FIGS. 2 and 3B, which depicts integral sidewalls 216 and interlocking sidewalls 316 as having a height exceeding that of walking surface 106. Thus, for example, the sidewalls described herein may range from about 0.5 inches in height to about 16 inches in height or more, such as about 1 to about 14 inches, about 2 to about 12 inches, or even about 3 to about 10 inches.

The orientation of the sidewalls (integral or interlocking) may be fixed or variable with respect to the surface of the primary endless belt. For example, the sidewalls may remain oriented substantially perpendicular to the upward facing surface of the primary endless belt throughout the rotation of the primary endless belt. Alternatively, the orientation of the sidewalls may vary as the primary endless belt rotates. For example, the sidewalls may be oriented substantially perpendicular to the surface of the primary endless belt in the region where a walking surface is disposed on the primary endless belt, and oriented substantially parallel to the surface of the primary endless belt when the walking surface is not disposed on the primary endless belt.

In the latter case, for example, as the primary endless belt rotates in counterclockwise direction the sidewalls may be guided into an upright orientation when the primary endless belt traverses a head roller at the front of the apparatus. After the walking surface falls off of the surface of the primary endless belt, the sidewalls may be guided into a substantially flat orientation, and may remain flat until again guided into an upright position at or near the head roller. To facilitate the movement of the sidewalls in this manner, one or more guides may be coupled to the apparatus at or near the head and tail rollers.

Regardless of whether the orientation of the sidewalls is fixed or variable, it may desirable to configure the sidewalls such that they are oriented substantially perpendicular to the upward facing surface of the primary endless belt. In such instances, the primary endless belt may be considered to have a substantially u-shaped cross section. A non-limiting illustration of this concept is shown in FIG. 2, wherein integral sidewalls 216 are oriented perpendicular to upward facing surface 214 of primary endless belt 102, thereby forming a "U" shape.

The sidewalls of the primary endless belt may be formed from the same or different material as the primary endless belt itself. In some embodiments, the sidewalls are formed from a material having greater resistance to mechanical deformation than the material used to form the primary endless belt. Regardless of their composition, the sidewalls may also be configured to have sufficient thickness and/or mechanical characteristics (e.g., structural rigidity) to resist the outward pressure exerted by the particulate material forming the walking surface.

By way of example, the sidewalls may be formed of a rubber, polymer, or composite material have a thickness ranging from about 0.1 to about 3 inches or more, such as about 0.25 to about 2.5 inches, about 0.5 to about 1.5 inches, or even about 0.75 to about 1.25 inches. Of course, the thickness of the sidewalls may vary within, above, or below the aforementioned ranges. The structural rigidity of the sidewalls may also be enhanced, e.g., by the use of backing elements, internal reinforcement elements, etc. As non-limiting examples of such rubber, polymer, and composite materials, mention is made of ethylene propylene diene rubber (EPDM), butadiene rubber (e.g., styrene butadiene rubber), butyl rubber, nitrile rubber, polyolefin, polyurethanes, polyamides, aramid fiber, and combinations thereof.

To facilitate movement of the walking surface, the upward facing surface of the primary endless belt may include surface features such as striations, indentations, bumps, grooves, ridges, combinations thereof and/or other features. Such features may be distributed randomly or in an ordered distribution along the upward facing surface of the primary endless belt. For example, the surface features may be oriented in a line extending substantially perpendicular to the lateral edges of the primary belt. Alternatively or additionally, the surface features may be oriented in a line substantially parallel to the lateral edges of the primary belt. Similarly, the surface features may be oriented in a line that is at an angle to the lateral edges of the primary endless belt. While not wishing to be bound by theory, it is believed that the surface features may assist in the transport of the walking surface by increasing the surface area of the primary belt that contacts the particulate material of the walking surface.

Whether or not sidewalls are used, particulate material forming the walking surface may escape the confines of the primary endless belt. To address this issue, the apparatus described herein may include one or more capturing mechanisms that function to collect particulate material before and prevent soiling of the environment surrounding the apparatus. By way of example, the apparatus described herein may include one or more catch pans located anywhere proximate to the walking surface, so as to effectively capture straying particulate material as the treadmill operates.

Figure 4:
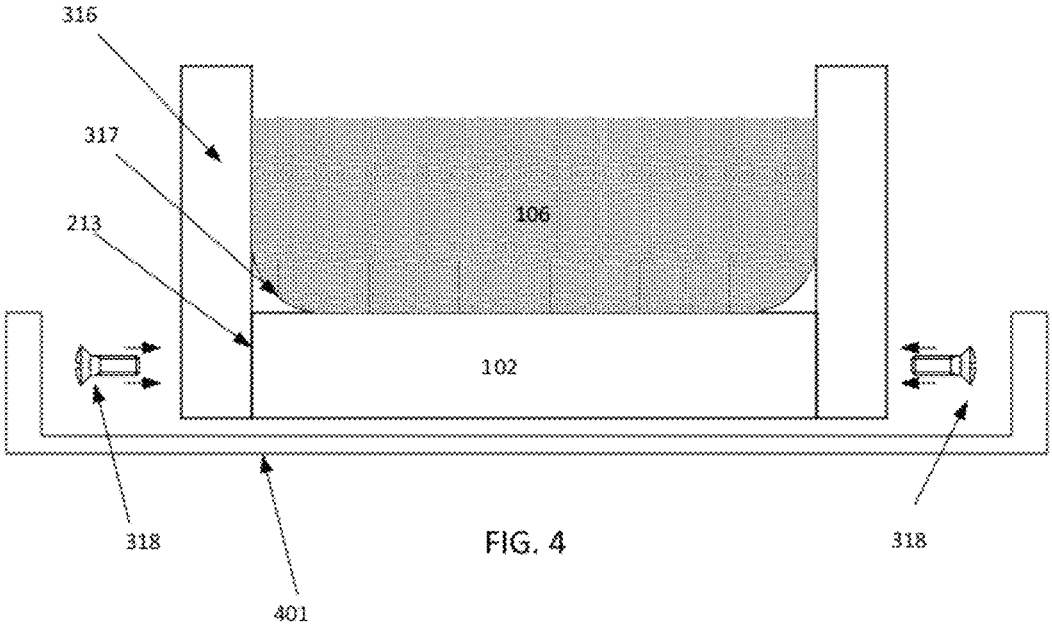
FIG. 4 is a cross sectional view showing a primary endless belt and a catch pan consistent with non-limiting embodiments of the present disclosure.

As a non-limiting illustration of this concept, reference is made to FIG. 4, wherein catch pans 401 are disposed adjacent to the lateral edges of primary endless belt 102. It should be understood, however, that catch pans and other capturing mechanisms may be provided at any suitable location within or about the apparatus described herein. Thus, for example, one or more capturing mechanisms may be located proximate to the head and/or tail roller(s) around which the primary endless belt is disposed. Likewise, one or more capturing mechanisms may be provided along the left and/or right side of primary endless belt or a roller thereof. In some embodiments the capturing mechanisms may be detached from the apparatus, thereby permitting easy disposal or reuse of the particulate material contained therein. In the case of catch pans, for example, handles (e.g., drawer type pull handles) may be included to facilitate easy removal and handling.

As mentioned above, the walking surfaces described herein may be transported along an upward facing surface of a primary endless belt as the primary endless belt rotates. At a position proximate to the rear of the primary endless belt, the walking surface disintegrates into its constituent particulate material as it flows off the primary endless belt in a rearward direction. To facilitate the continuous use of the apparatus by a user, it may be desirable to recirculate the material flowing off the rear of the primary endless belt back to the upward facing surface of the primary endless belt. To facilitate this recirculation, the present disclosure contemplates a return transport system that receives particulate material from a position proximate to a read end of the apparatus described herein, and transports it to an upward facing surface of the primary endless belt, preferably at (but not limited to) a position proximate to the front end of the apparatus.

In some embodiments, the return transport system includes an endless return belt that returns particulate material from the rear of the primary endless belt to the front of the primary endless belt. In this regard, reference is made to FIG. 5A, which illustrates a non-limiting example of an apparatus 100 including a return transport system 110 that includes an endless return belt 502. As shown, at least a portion of endless return belt 502 is positioned so as to receive particulate material from primary endless belt 102. Endless return belt 502 is rotatably disposed around transport rollers 504. Like the primary endless belt, endless return belt 502 may include integral or interlocking sidewalls (hereafter referred to as "return sidewalls"), such as return sidewalls 610 shown in FIG. 6A.

During operation of apparatus 100, endless return belt 502 conveys the particulate material from a position proximate to the rear end of primary endless belt 102, to a position proximate to the front end of primary endless belt 102. Return transport system 110 may perform this action independently, or by interacting with at least a portion of primary endless belt 102, as will be described below.

Figure 5B:
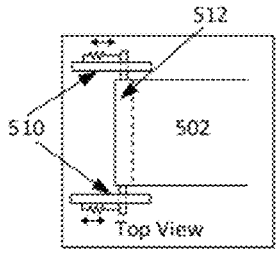
FIG. 5B is a top view of an exemplary tensioner configuration consistent with non-limiting embodiments of the present disclosure.
Figure 5A:
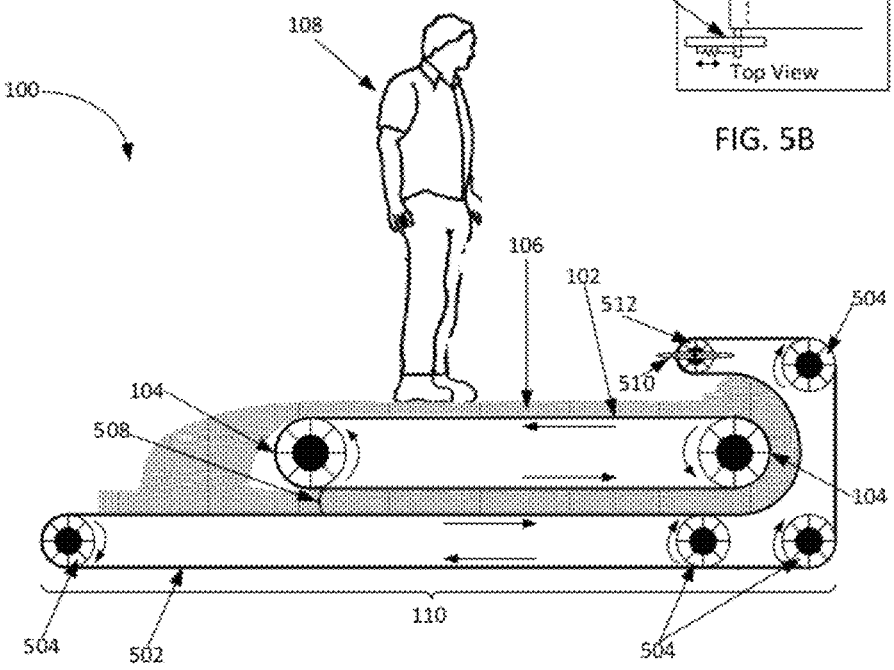
FIG. 5A is a side view of an apparatus including a tensioner in accordance with non-limiting embodiments of the present disclosure.

As further shown in FIG. 5A, a least one of transport rollers 504 may be driven in a motorized fashion, thereby causing endless return belt 502 to rotate in an opposite direction as primary endless belt 102. Thus, for example, if primary endless belt 102 rotates in a counterclockwise direction, endless return belt 502 may rotate in a clockwise direction, and vice versa. By virtue of this counter rotation, particulate material deposited on endless return belt 502 may be conveyed between primary endless belt 102 and endless return belt in region 508, and towards the front of apparatus 100. In this way, the surfaces and rotation of primary endless belt 102 and endless return belt 502 facilitate the forward conveyance of the particulate material.

As the walking surface height increases or decreases, the total mass of particulate material that comprises the walking surface may increase proportionally. Therefore, it may be necessary to adjust the return transport system to accommodate the corresponding greater or lesser amount of particulate material.

Accordingly, in some embodiments of the present disclosure a tensioner is coupled to at least one of the primary endless belt and the endless return belt. By adjusting the tension of the primary endless belt and/or the endless return belt, the tensioner can control the amount of space that is present between such belts. Further, by controlling the tension of the endless return belt and/or the primary endless belt, the tensioner may cause one or more of such belts to exert force against particulate material that is flowing between their respective surfaces.

As a non-limiting example of this concept, reference is made to FIGS. 5A and 5B, wherein tensioner 510 is capable of adjusting the tension of endless return belt 502. For example, tensioner 510 may be capable of lateral movement that increases or decreases the tension of endless return belt 502 around transport rollers 504. The tension of primary endless belt 102 may be adjusted similarly, either by tensioner 510, another tensioner, or via some other means (not shown). By adjusting the tension of the primary endless belt 102 and the endless return belt 502, the amount of space between primary endless belt 102 and endless return belt 502 may be adjusted, thereby permitting the disposition of greater or less particulate material between their respective surfaces. That is, such tension adjustments can control the volume of region 508 between primary endless belt 102 and endless return belt 502.

Further, such tension adjustments may result in a corresponding adjustment to the amount of force that is exerted by primary endless belt 102 and endless return belt 502 on the particulate material that is present between their respective surfaces. Although not wishing to be bound by theory, it is believed that increasing the amount of force exerted on the particulate material by the primary endless belt 102 and the endless return belt 502 may enhance contact between the particulate material and the respective surfaces of primary endless belt 102 and endless return belt 502, thereby facilitating the forward conveyance of the particulate material.

In some embodiments, the forward conveyance of particulate material is further enhanced by structures present on the surface of the primary endless belt or the endless return belt. For example, the endless return belt may include one or more ribs, grooves, striations, bumps, and ridges that extend across all or a portion of the endless return belt on the side facing the primary endless belt. Likewise, the primary endless belt may include one or more ribs, grooves, striations, bumps and ridges that extend across all or a portion of the primary endless belt on the side facing the endless return belt.

Figure 6A:
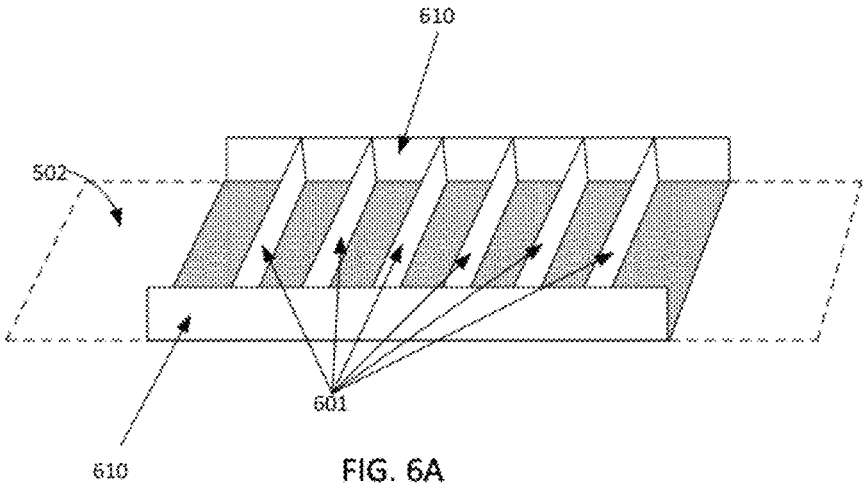
FIG. 6A is a partial perspective view of an endless return belt in accordance with non-limiting embodiments of the present disclosure.

As a non-limiting illustration of this concept, reference is made to FIG. 6A, wherein a plurality of ribs 601 extend across the entire width of endless return belt 502. While ribs 601 are shown as being placed periodically along endless return belt 502, it should be understood that only one rib may be used, or that a plurality of randomly or intermittently placed ribs may be used. Likewise, Ribs 601 need not extend across the entire width of endless return belt 502. Indeed, the present disclosure envisions ribs that extend from about 1 to about 99% across the width of endless return belt 502, and all endpoints and ranges within such range.

In some embodiments, ribs 601 form a raised region on the surface of endless return belt 601. As non-limiting examples of the configuration of such raised regions, reference is made to FIG. 6B, wherein rib 601 is depicted as having at least one of a square 604, rectangular 606, or wave-like 608 shape when viewed from the side of the endless return belt. Of course, such shapes are exemplary only, and any shape facilitating the movement of particulate material by the endless return belt may be used. Like the sidewalls described above, the at least one rib may be integral to the endless return belt (i.e., formed from the same piece of material) or it may be a separate piece that is affixed to the endless return with a fastening means such as a glue, epoxy, a screw, a nail, a rivet, etc.

In some embodiments, the endless return belt and the at least one rib are each made of durable material capable of both supporting and moving a portion of the particulate material and mating with the primary return belt. Non-limiting examples of this material include durable materials known in the art, such as a rubbers, polymers, and composites. For example, the endless return belt and at least one rib may be manufactured from natural rubber, butyl rubber, ethylene propylene diene monomer rubber (EPDM), nitrile rubber, polyamides, polyolefins, aramid fiber, and combinations thereof.

Figure 6B:
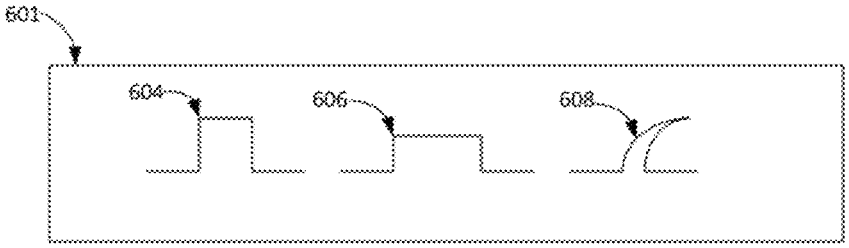
FIG. 6B is a cross sectional view of exemplary rib profile configurations in accordance with non-limiting embodiments of the present disclosure.

As may be understood from FIGS. 5, 6A and 6B, as endless return belt 502 rotates, ribs 601 can exert force on particulate material received from primary endless belt 102 in the direction the endless return belt 502 rotates. In this way, ribs 601 can facilitate the return of particulate material to a position proximate to the front of apparatus 100. Moreover, ribs 601 may assist in moving the particulate material to the top of primary endless belt 102, again by exerting force on the particulate material as ribs 601 traverses the rotational path of endless return belt 502.

In some embodiments, the at least one rib of the endless return belt mates with the surface and the sidewalls of primary endless belt, thereby forming one or a plurality of transport chambers. Each of such transport chambers may be defined by the surfaces of the primary and endless return belts, the surfaces of the at least one rib (of the endless return belt and/or the primary endless belt), and the inner surface(s) of the sidewalls of the primary endless belt. In such instances, each transport chamber may be considered a substantially four walled container.

In some embodiments, the transport chambers may form elongated rectangular transport chambers that run lengthwise along the direction perpendicular to the conveyance direction of endless return belt. Such transport chambers may be formed by mating the primary endless belt and sidewalls with the endless return belt and the at least one rib. In instances where return sidewalls are used, the primary endless belt sidewalls and the return sidewalls may also be configured so as to mate, again to form one or more transport chambers. Of course, it should be understood that the return sidewalls may independently mate with the surface of the primary endless belt, thereby forming the sides of a transport chamber independent of any sidewall of the primary endless belt.

Figure 7A:
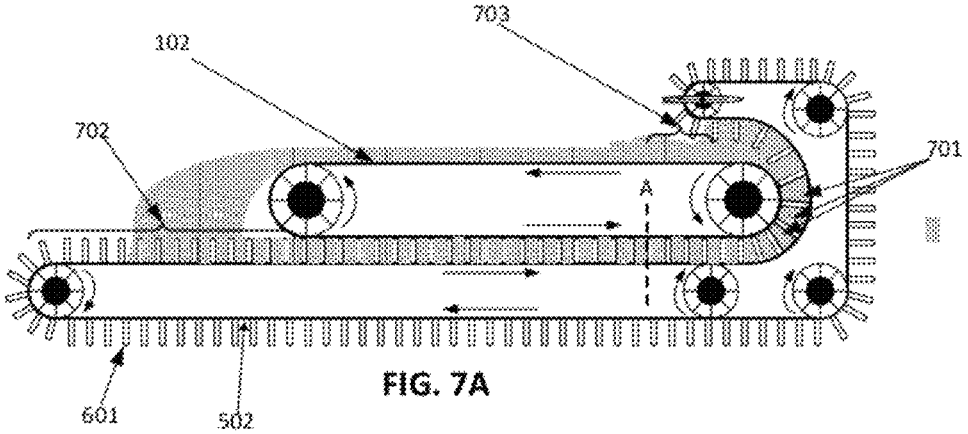
FIG. 7A is a side view of an apparatus including a plurality of return transport chambers in accordance with non-limiting embodiments of the present disclosure.
Figure 7B:
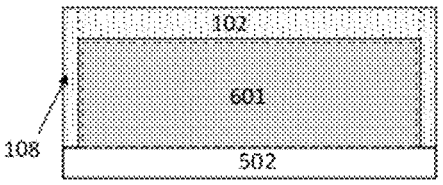
FIGS. 7B, 7C, and 7D are cross sectional views taken at line A of FIG. 7A, and illustrate non-limiting configurations of return transport chambers consistent with the present disclosure.
Figure 7C:
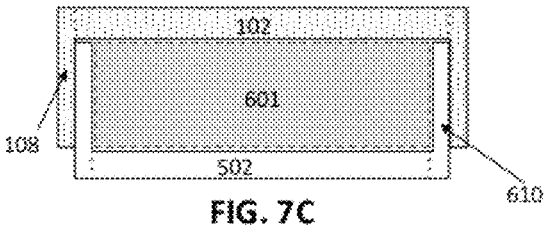
Figure 7D:
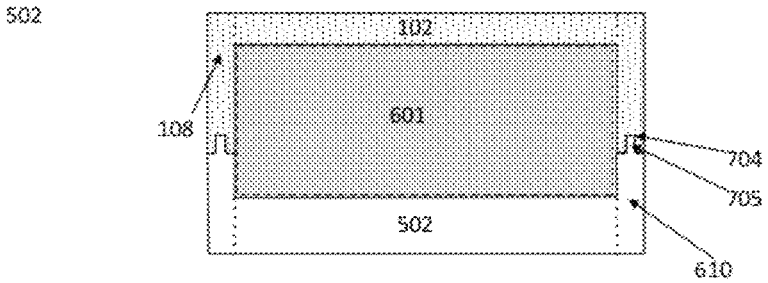

As a non-limiting illustration of the use and formation of transport reference is made to FIGS. 7A, 7B, 7C, and 7D, wherein transport chambers 701 are formed between primary endless belt 102 and endless return belt 502. As shown in FIGS. 7B, 7C, and 7D, each transport chamber 701 is defined by surfaces of primary endless belt 102, endless return belt 502, at least one rib 601, sidewalls 108 and return sidewalls 610. To facilitate the filling of transport chambers 701 with particulate material, at least a portion of endless return belt 502 extends past the edge of primary endless belt. In the non-limiting example shown in FIG. 7A, for example, region 702 of endless return belt 502 is located to the rear of primary endless belt 102. In region 702, endless return belt 502, ribs 601, and return sidewalls 610 define a substantially three walled "open" transport chamber such as, for example, those shown in FIG. 6A.

As primary endless belt 102 rotates, particulate material flows off of its upward facing surface in a rearward direction, filling the open transport chambers described above. As the open transport chambers are transported forward by endless return belt, rib 601 mates with the surface of primary endless belt 102 and sidewalls 108, thereby "closing" the transport chambers as the particulate material is conveyed forward and around a forward end of primary endless belt 102. In region 703, primary endless belt 102 and sidewalls 108 disengage from endless return belt 502, opening transport chambers 701 and allowing the particulate material contained therein to be deposited on an upward facing surface of primary endless belt 102.

FIGS. 7B, 7C, and 7D show different non-limiting embodiments of the mating of primary endless belt 102 with endless return belt 502 and/or return sidewalls 610. In the non-limiting embodiment shown in FIG. 7B, sidewalls 108 of primary endless belt 102 may mate with the surface of endless return belt 502, thus forming an elongated chamber. The elongated chamber may be subdivided into individual transport chambers 701 by rib 601, which may extend from the surface of endless return belt 502 to the surface of primary endless belt 102. In the non-limiting embodiment shown in FIG. 7C, transport chambers are formed in a similar manner as shown in FIG. 7B, except that sidewalls 108 of primary endless belt 102 mate (e.g., nest) with return sidewalls 610 of endless return belt 502. And in the non-limiting embodiment shown in FIG. 7D, return sidewalls 610 and or sidewalls 108 include at least one female notch 704, which may mate with a corresponding male protrusion 705 on the sidewall of the opposing belt.

As previously explained above, as the height of the walking surface 106 increases or decreases, the total mass of particulate material that is included in the walking surface may increase or decrease proportionally. To accommodate this variability, the return transport system may be configured such that the capacity of the transport chambers is adjusted to account for variations in particulate material flow. In this regard, apparatus 100 may be configured such that the size of the transport chambers and/or the compression force between the primary endless belt and the transport belt may be adjusted.

For example, and as described previously with respect to FIGS. 5A and 5B, a tensioner 510 may be coupled to one or both of primary endless belt 102 and return transport belt 502. Tensioner 510 may be configured so as to manually or automatically adjust the position of endless return belt 502 relative to the position of primary endless belt 102. Moreover, tensioner 510 may adjust the tension of endless return belt 502 and/or primary endless belt 102. In this way, tensioner 510 may adjust the volume of transport chamber 701, as well as the compression force exerted on the particulate material in such chambers by primary endless belt 102 and endless return belt 502.

In some embodiments, tensioner 510 may function by adjusting the position of one or more of the rollers about which endless return belt 502 is disposed. In such embodiments the tensioner may, for example, be a spring tensioner that adjusts the position of one or more rollers by expanding or compressing a spring. The spring may be attached to a fitting that may slides forward and backward along the axis of the primary endless belt. In some embodiments, this fitting may also house an axle of one of the rollers of the endless return belt, such as return head roller 512 in FIGS. 5A and 5B. In this way, the position of the return head roller 512 may be adjusted within a guide (not shown) that slides forwards and backwards to provide appropriate tension on the belt based on the volume of particulate that is being transported. By adjusting the position of return roller 512, e.g. in a direction parallel to the movement of the walking surface 106, the volume or transport chambers 701 and the compression force between primary endless belt 102 and endless return belt 502 may be increased or decreased.

While FIGS. 5A and 5B depict tensioner 510 as coupled to return head roller 512, it should be understood that one or more tensioners may also be coupled to any of return rollers 504 so as to enable control of the tension of endless return belt 502. Likewise, tensioners may be coupled to rollers 104, so as to enable control of the tension of primary endless belt 102.

Figure 8A:
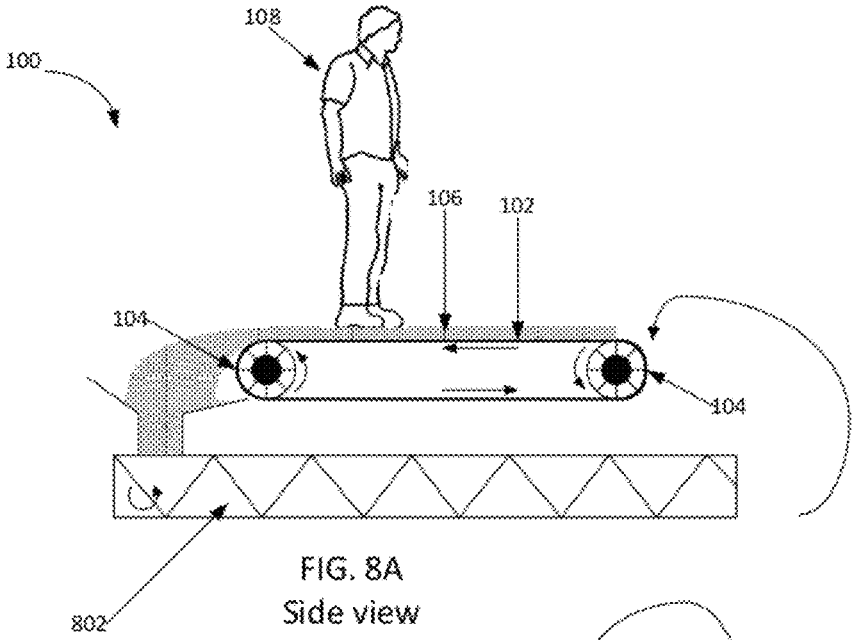
FIGS. 8A and 8B are side and top views, respectively, of an apparatus including a screw auger consistent with non-limiting embodiments of the present disclosure.
Figure 8B:
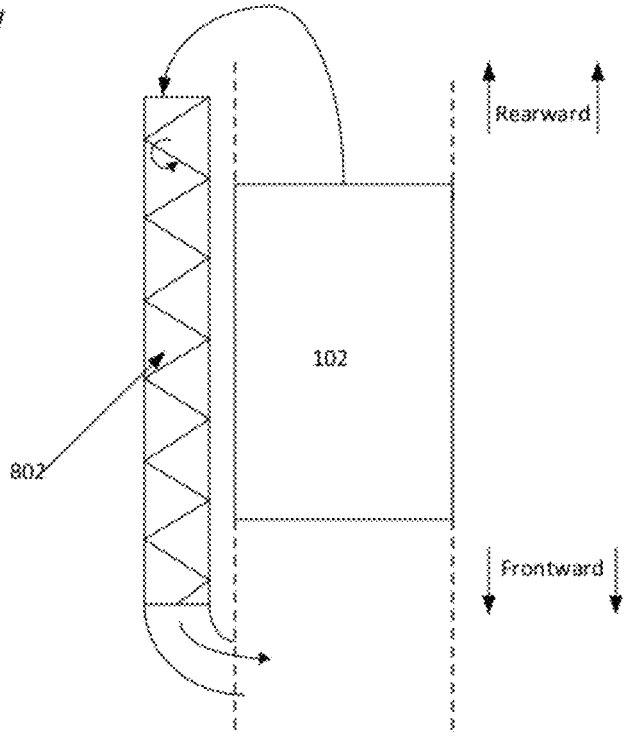

In some embodiments, return transport system 110 includes a screw auger 902 instead of or in addition to an endless return belt. A non-limiting example of this concept is illustrated in FIGS. 8A and 8B. As shown in such FIGS., apparatus 100 may include at least one screw auger 802 that is situated, for example, near the side or underneath primary endless belt 102, and may span all or a portion of the length of apparatus 100. Generally, screw auger 802 operates by receiving particulate material from primary endless belt 102, and forcing this particulate material into contact with a rotating screw. As the screw of screw auger 802 rotates, particulate material contacting the screw may be propelled forward by the screw thread. In this way, particulate material may be conveyed by screw auger 902 to a position proximate to a front end of apparatus 100 and/or primary endless belt 102. At that time, the particulate material may be deposited back onto the front of the primary endless belt, e.g., by a moving inclined plane, an elevator, a vacuum, or other pneumatic, hydraulic, or mechanical means (not shown).

When the particulate material falls from the tail end of the primary belt, its behavior may be somewhat unpredictable, and may result in a "spraying" or "dusting" effect if left unobstructed to strike the return transport system. This spraying may result in the loss of some of the particulate material, and/or cause the return transport system to fail to convey all of the particulate material back to the front of the apparatus. Thus, in some embodiments of the present disclosure, a hopper is included to collect particulate material flowing off the rear of the primary endless belt and deliver it to the return transport system.

Figure 9A:
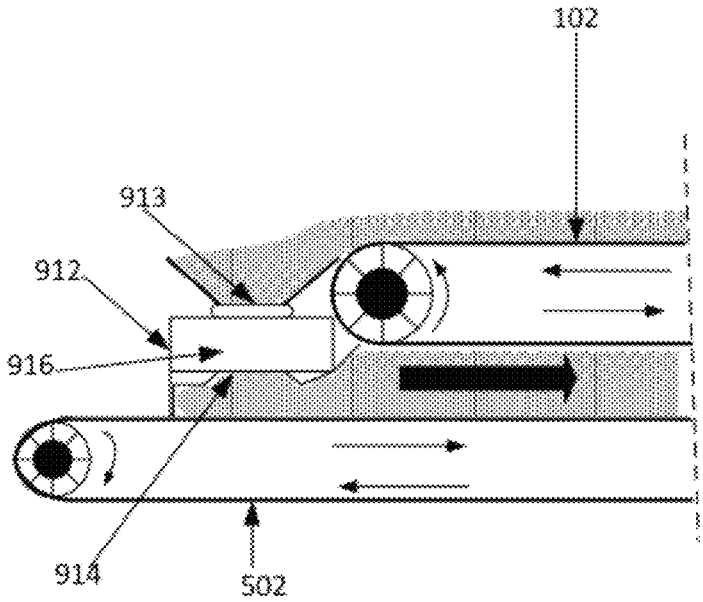
FIGS. 9A and 9B are partial side and perspective views, respectively, of an apparatus including a hopper in accordance with non-limiting embodiments of the present disclosure.
Figure 9B:
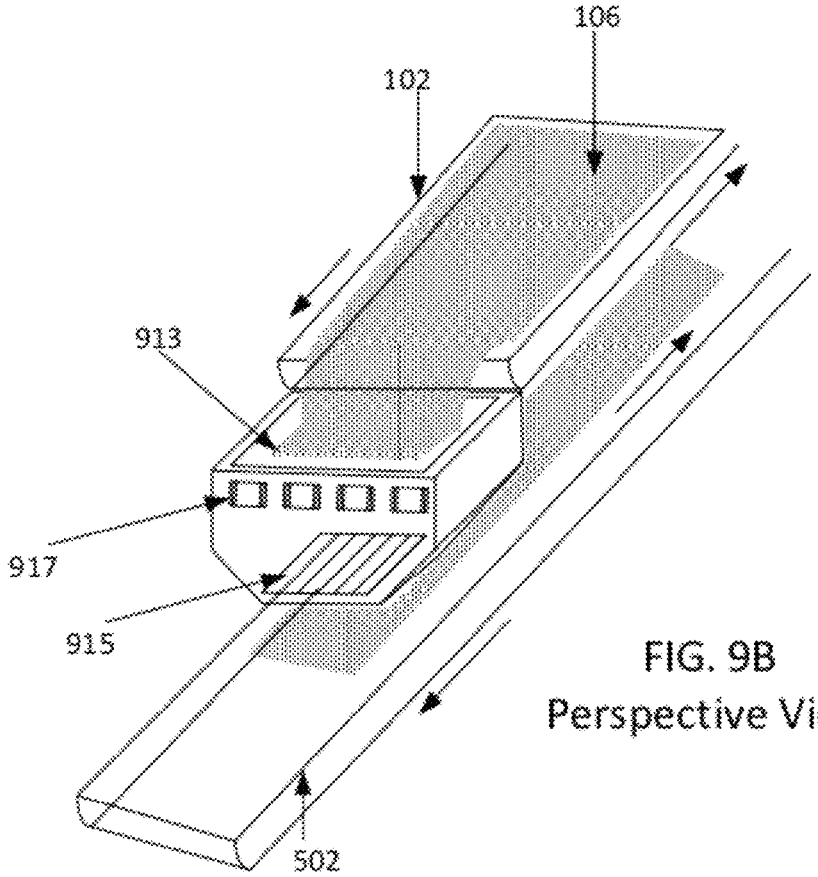

FIGS. 9A and 9B illustrate a non-limiting example of an apparatus including a hopper in accordance with some embodiments of the present disclosure. As shown, hopper 912 is situated near the rear end of apparatus 100 and, more particularly, to the rear of primary endless belt 102. As particulate material of walking surface 106 flows off primary endless belt 102, it flows into a first opening 913 of hopper 912. Hopper 912 may then deliver the particulate material to the return transport system by way of second opening 914. For the sake of illustration only, the return transport system is depicted in FIGS. 9A and 9B as including endless return belt 502

Hopper 912 may serve to collect particulate material from primary endless belt 102 and redirect it to the return transport system. In some embodiments, however, hopper 912 is configured to provide additional functionality. For example, hopper 912 may be configured to control the rate at which particulate material is delivered to the return transport system. In this regard, hopper 912 may include a metering mechanism 915 that controls the flow of particulate material through second opening 914, as shown in FIG. 9B. As non-limiting examples of such a metering mechanism, mention is made of adjustable grates, variable orifices, adjustable valves, baffles, and other mechanisms that are suitable for controlling the flow of particulate material through an opening. In some embodiments, metering mechanism 915 is an adjustable grate disposed within, above, or below second opening 915 of hopper 912.

In some embodiments, hopper 912 is configured to include a container 916 for particulate storage. In such embodiments, hopper 912 can collect and store particulate material flowing off primary endless belt 102 for later distribution to return transport system 110. Hopper 912 may also be oriented so as to facilitate transfer of particulate material from primary endless belt 102 to return transport system 110. For example, where the return transport system includes a screw auger below that is adjacent to primary endless belt, hopper 911 may slope towards the screw auger so as to facilitate the flow of material from primary endless belt 102 to the screw auger.

Hopper 912 may further include at least one heating element 917, as shown in FIG. 9B. Heating element 917 can function to increase the temperature of the particulate material received from primary endless belt 102. Non-limiting examples of such heating elements include resistive heating elements, infrared heating elements, and heating lamps. In this way, hopper 912 can be used to adjust the temperature of the particulate material, thereby opening avenues to a variety of heat treatment therapies, as will be discussed below.

When the return transport system deposits the particulate material on the front end of the primary endless belt, the resulting mass of particulate may be uneven in distribution and in height. Such a mass of particulate may be a sub-optimal walking surface for a user. To address this issue, some embodiments of the apparatus described herein include a screed that functions to manipulate the mass of particulate material deposited by the return transport system into a walking surface for presentation to a user. When used, such a screed may be placed downstream of the point at which the return transport system delivers particulate material to the primary endless belt. As such, particulate material delivered by the return transport system may be worked upon by the screed prior to the presentation of such material as a walking surface to a user of the apparatus.

Figure 10A:
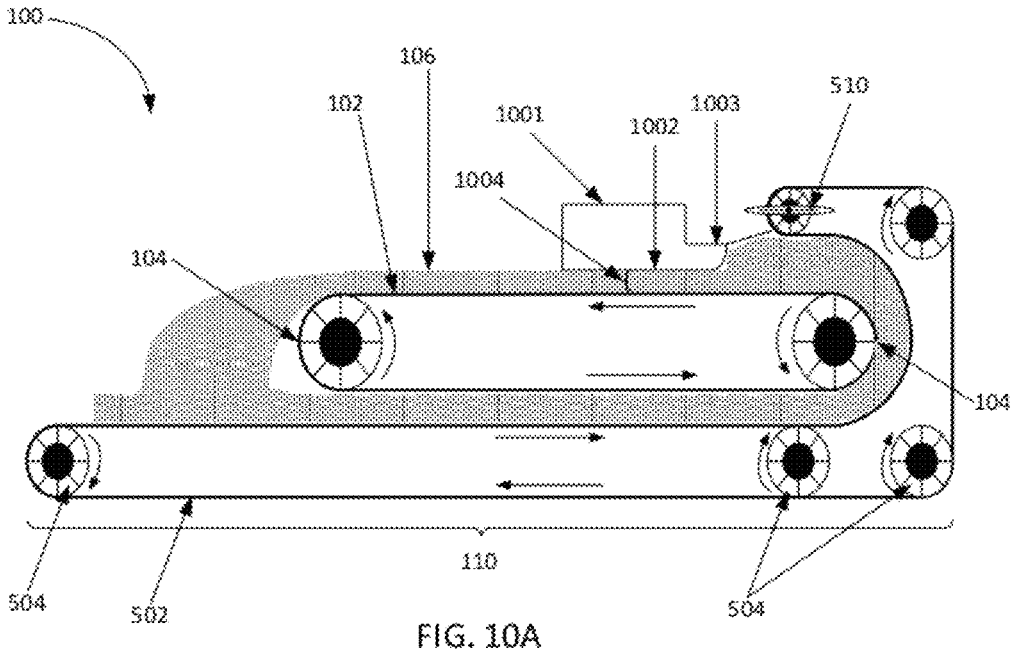
FIG. 10A is a side view of an apparatus including a screed in accordance with non-limiting embodiments of the present disclosure.

FIG. 10A depicts a non-limiting example of an apparatus 100 that includes a screed 1001 in accordance with some embodiments of the present disclosure. As shown, screed 1001 includes a grading plate 1002. As particulate material flows rearward on primary endless belt 102, it encounters grading plate 1002, which can redistribute the particulate material across the width of primary endless belt 102. Screed 1001 can also include a distribution mechanism, such as but not limited to a distribution arm (not shown). In such embodiments, the distribution mechanism may facilitate the distribution of particulate material across the width of screed 1001 and/or grading plate 1002. In some cases, the distribution mechanism can assist screed 1001 to produce a walking surface that has a desired distribution across the width of primary endless belt 102.

Figure 10B:
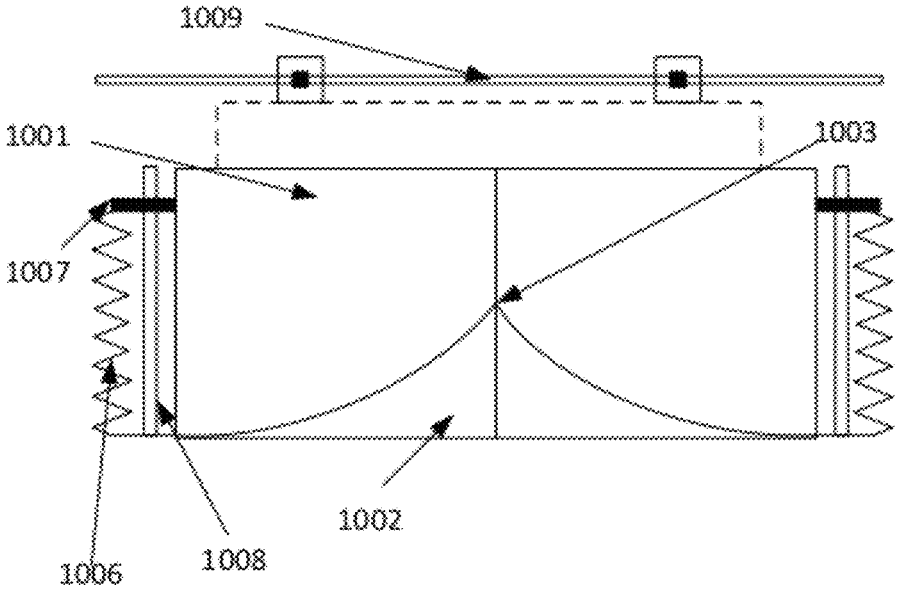
FIGS. 10B and 10C are front and side views of alternate configurations of a screed having a spring based height adjustment mechanism in accordance with non-limiting embodiments of the present disclosure.

The shape of grading plate 1002 may vary widely. For example, grading plate 1002 may have a substantially geometric shape (e.g., a line, a rectangle, a square, a triangle, etc.), a curvilinear shape or a combination thereof. In some embodiments, and as shown in FIG. 10B, grading plate 1002 of screed 1001 has a "V" shape that is similar to that of v-bottom boat. In such embodiments, the screed may include an elongated prow 1003 at a position proximate to the front end of the treadmill. Prow 1003 may be tapered in height from a centerline of primary endless belt 102 toward each lateral side, such that when particulate material is deposited onto the upward facing surface of primary endless belt 102, at least a portion of the particulate material is diverted to the sides of primary walking surface 102 when it encounters prow 1003. In this way, particulate material encountering screed 1001 may be spread across the entire width of primary endless belt 102.

Grading plate 1002 may also include structural features that impart a surface finish to the particulate material passing between grading plate 1002 and primary endless belt 102. For example, grading plate 1002 may include ridges (not shown) disposed at an edge thereof, such that ridges, lines or other surface features are imparted to walking surface 106. In some embodiments, structures on grading plate 1102 impart a "raked" appearance to walking surface 106. Such surface features can increase the visual texture of walking surface 106, and may provide better depth perception to a user of apparatus 100.

In some embodiments, screed 1001 and/or grading plate 1002 may be computer controlled, and may include a plurality of paddles controlled with a programmable motor such that each paddle may lift up and down independent of neighboring paddles. In some embodiments, such paddles may be about 1-2 inches wide, though other widths are of course possible. Accordingly, if the walking surface is three fee wide, grading plate 1002 may include 16-32 independently actuatable paddles.

As may be appreciated, such paddles may be used to control the depth and/or distribution of the particulate material of the walking surface as it passes under grading plate 1002 and screed 1001. In this way, such paddles may also create diagonal ridges in the walking surface. For example, diagonal ridges may be formed by controlling the time at which each paddle is raised, relative to its neighbor. In some embodiments, m each paddle is raised with a time delay from its earlier raised neightbor, and then lowered with the same delay after a ridge is formed in the walking surface.

In this way, ridges of varying angle and distribution may be formed in the surface of the walking surfaces described herein. Such ridges can be controlled to drift in from right to left and left to right at angles ranging from purely perpendicular to an edge of the walking surface (i.e., 0 degrees or about 0 degrees) to about 65 degrees, such as about 0 to about 50, about 0 to about 45, about 0 to about 30, about 0 to about 20, and about 0 to about 10 degrees. Such paddles may also be actuated to create relief shapes of "targets" that are sized and positioned so as to aid in gait re-training, i.e., training a subject to step with a prescribed step length and width.

The maximum height of walking surface 106 may be determined by the size of opening 1004 between grading plate 1002 and primary endless belt 102. As such, it should be understood that the position of screed 1001 and/or grading plate 1002 may be set so as to produce a walking surface 106 of a desired height. Accordingly, the position of screed 1001 and/or grading plate 1002 relative to primary endless belt 102 may be fixed or variable. In some embodiments, screed 1001 and/or grading plate 1002 may be actuated towards or away from the upward facing surface of primary endless belt, thereby defining the size of the opening between the bottom of grading plate 1002 and the upward facing surface of primary endless belt 102. When variable, the position of screed 1001 and/or grading plate 1002 may be adjusted manually, mechanically, pneumatically, hydraulically, or a combination thereof. In some embodiments, the position of screed 1001 and/or grading plate 1002 is adjusted using a variety of height adjustment mechanisms, as shown in FIGS. 10B, 10C, and 10D.

With reference to FIG. 10B, the height of screed 1001 and/or grading plate 1002 may be adjusted via the use of one or more springs. As shown, springs 1006 may be coupled to either or both sides of screed 1001 and/or distribution plate 1002, e.g., by connector 1007, which may be disposed through guide 1008. Connector 1007 may be, for example a pin, a rod, a screw, a bearing, and/or another connector.

Screed 1001 may also be connected to a support structure (not shown), e.g., via rod 1009 or another type of fastener. Connector 1007 may, via a displacement rod or other means (not shown), be movable within the range of guide 1008. Thus, for example connector 1007 may be displaced downward in guide 1008, compressing springs 1006 and lowering the height of screed 1001 and/or grading plate 1002.

Figure 10C:
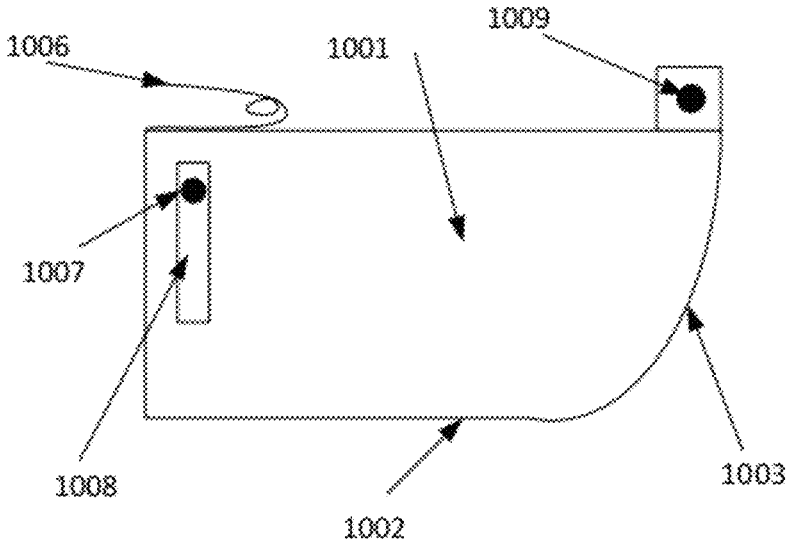
Figure 10D:
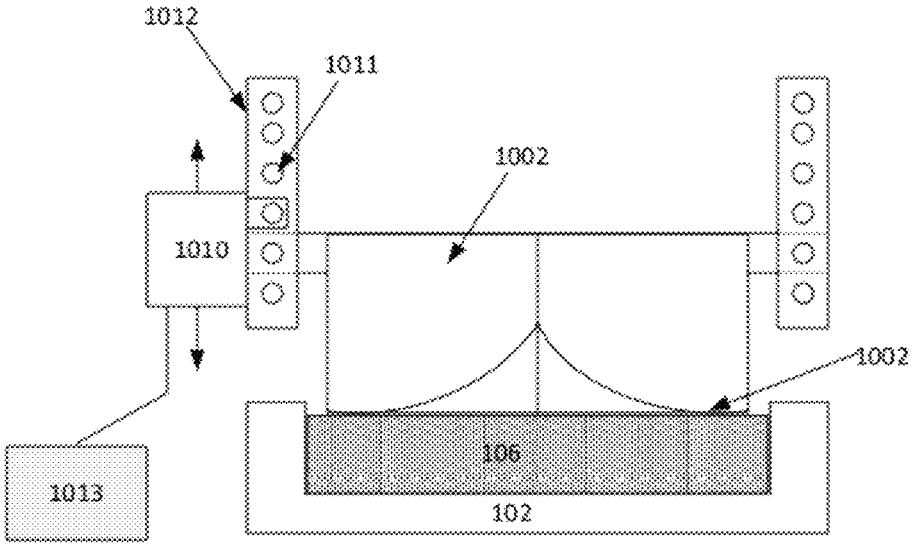
FIG. 10D is a front view of a screed having a motor actuated height adjustment mechanism in accordance with non-limiting embodiments of the present disclosure.

FIG. 10C provides a non-limiting illustration of an alternative configuration of a height adjustment mechanism that can be used to adjust the height of screed 1001 and/or grading plate 1002. As shown, FIG. 10C includes many of the same elements as were previously described with reference to FIG. 10B, and so such components are not reiterated herein. Of note in FIG. 10C is the placement of spring 1006 and rod 1009. Specifically, spring 1006 is shown as biasing the top of screed 1001. Thus, in this particular example, spring 1006 does not directly cushion rod 1007 as it is displaced through the range of guide 1008.

FIG. 10D provides a non-limiting illustration of another alternative configuration of a height adjustment mechanism that can be used to adjust the height of screed 1001 and/or grading plate 1002. In this non-limiting embodiment, screed 1001 is coupled to an actuator 1010 that is capable of adjusting (e.g., mechanically, hydraulically, pneumatically, etc.) the height of screed 1001 and/or grading plate 1002 to one of a plurality of pre-set heights defined by height notches 1011 of a notched guide 1012. By way of example, actuator 1010 may be raised and lowered by a tooth drive gear (not shown) on a motor that drives a toothed rack up and down so as to convert rotation of the motor to a linear displacement of screed 1001 along the height of notched guide 1012.

Height notches 1011 may be set at increments of equal or unequal offset. Such offset may range, for example, from about one millimeter to about five centimeters. Alternatively, the offset may range from about five millimeters to about three centimeters. In some embodiments, the offset may be about one centimeter.

In some embodiments, actuator 1010 may be electronically controlled, e.g., by a control system 1013 operatively coupled thereto. In operation, control system 1013 may control actuator 1010 in accordance with a pre-programmed routine and/or in response to inputs made by a user. In this way, a user may select a particular walking surface height through control system 1013, and control system 1013 may send a corresponding electrical signal to actuator 1010 that indicates the user-selected walking surface height. In response, actuator 1010 may operate to move grading plate 1002 and/or screed 1001 to a height notch 1010 that corresponds to the user selected walking surface height. Of course, a user may set other options through control system 1013, such as but not limited to the particulate material temperature, particulate material distribution, and the speed of the primary endless belt.

As may be appreciated from the foregoing, the screeds described herein may be configured to move up and down in a fixed track, or guide. The fixed track may include one or a plurality of attachment points per side. In some embodiments, the fixed track includes at least two attachment points per side, so as to maintain the orientation of the screed with a level presentation, thereby allowing the screed to divert mounded sand deposited from the endless return belt into a substantially even, smooth surface.

In some embodiments, the position of screed 1001 and/or grading plate 1002 may be manually adjusted. Thus for example, screed 1001 may include at least one male rod that is of a size and shape that is suitable for mating with female slots provided in a support frame or other height defining mechanism adjacent to screed 1001.

The position of screed 1001 and/or grading plate 1002 may be used control the height of layer of particulate material that is allowed to pass between screed 1001/grading plate 1002 and primary endless belt 102. For example, holding grading plate 1002 in a fixed position can result in a walking surface 106 having a substantially constant depth. In contrast, oscillating grading plate 1002 towards and away from primary endless belt 102 can result in a walking surface 106 having a varying height. In this way, screed 1001 and/or grading plate 1002 may be used to provide a walking surface 106 of fixed or variable height, as described previously.

Similar to hopper 912 described above, screed 1001 and the components thereof may be configured to include at least one heating element (not shown). Non-limiting examples of such heating elements include resistive heating elements, infrared heating elements, and heating lamps. In some embodiments, one or more heating elements may be coupled to a screed such that all or a portion of the screed is warmed by such heating elements. In turn, the screed may transfer heat to the particulate material that contacts and/or passes beneath it. In this way, the screeds described herein may be used to adjust the temperature of the particulate material included in the walking surfaces of the present disclosure.

While the present disclosure has previously described the use of heating elements coupled to a hopper or a screed, it should be understood that the use of heating elements is not limited to such locations. Indeed, heating elements may be placed anywhere along the apparatus 100 described herein, so long as they are capable of raising the temperature of the particulate material. For example, one or more heating elements may be placed underneath the upward facing surface of primary endless belt 102, alongside the upward facing surface of primary endless belt 102, within region 508 between primary endless belt 102 and endless return belt 502, underneath the upward facing surface of endless return belt 502, adjacent to Screed 1001, coupled to Screed 1001, on a support structure of the apparatus, on a motor of the apparatus, and combinations thereof.

To conserve energy, it may be desirable to position the heating elements such that the particulate material of the walking surface is heated for a short time (e.g., 1-30 seconds) prior to the presentation of the walking surface to a user. And like other aspects of the apparatus described herein, each heating element may be controlled by a control system 1108, thereby allowing the temperature of the walking surface to be controlled precisely.

The temperature of the particulate material may vary widely. For example, the temperature may range from about 40 degrees to about 200 degrees Fahrenheit, such as about 50 to about 180 degrees Fahrenheit, about 60 to about 160 degrees Fahrenheit, about 70 to about 140 degrees Fahrenheit, or even about 80 to about 125 degrees Fahrenheit. Of course, temperatures falling above, below, or within such ranges may be used, and are envisioned by the present disclosure. In some embodiments, the temperature of the particulate material may range from about 85 to about 120 degrees Fahrenheit, such as about 90 to about 115 degrees Fahrenheit, about 95 to about 110 degrees Fahrenheit, or event about 100 to about 105 degrees Fahrenheit.

In some embodiments, the temperature of the particulate material forming the walking surface may be adjusted so as to achieve a desired effect on a user of the apparatus. For example, the temperature of the particulate material may be adjusted to as to improve the tactile feedback experienced by a user on the apparatus. In addition, raising the temperature of the particulate can increase the energetic cost of walking, as the heat of the particulate material can capitalize on the exogenic behavior of a user's body, thereby causing it to burn more calories.

In further non-limiting embodiments, the apparatus of the present disclosure can include an audio visual system. Such a system may be coupled directly to the apparatus, e.g., as a video screen positioned in front of a user. Additionally or alternatively, the audio visual system includes one or a plurality of video screens positioned around the apparatus. In some embodiments, such video screens may be of a size and configuration as to provide the user with the simulated experience of being in another location.

Figure 11:
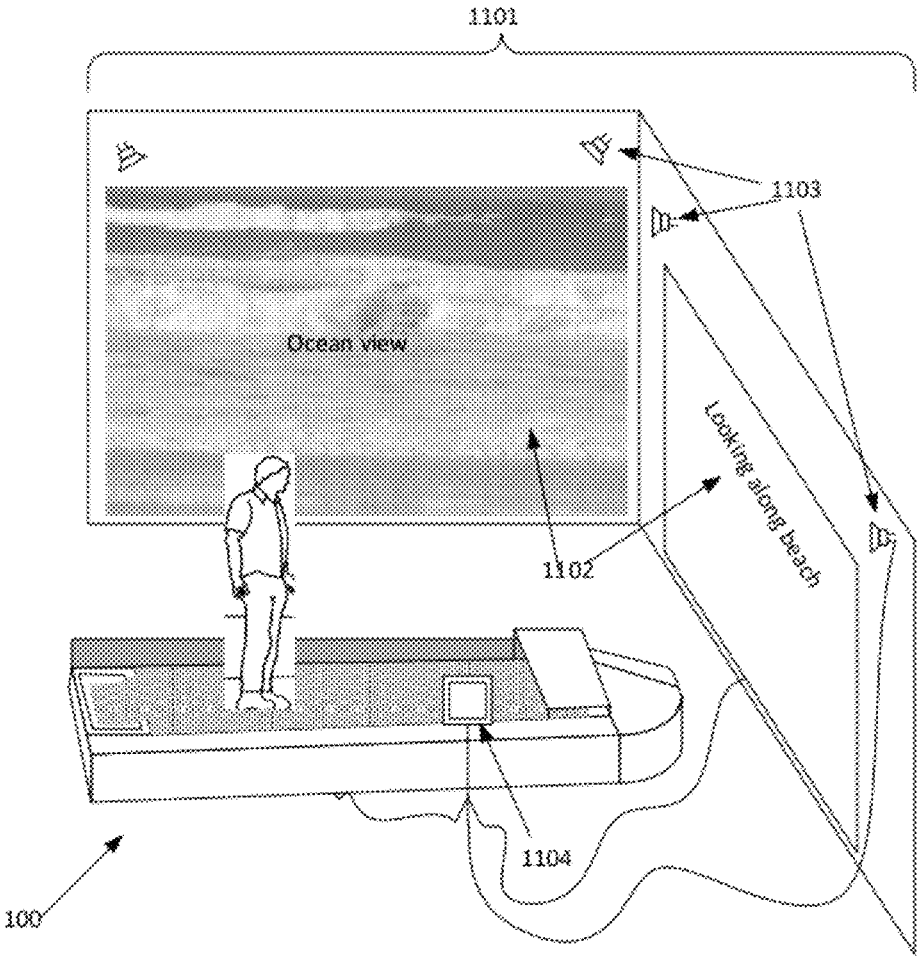
FIG. 11 is a perspective view of an apparatus including an audio visual system consistent with non-limiting embodiments of the present disclosure.

FIG. 11 illustrates a non-limiting example of an apparatus 100 including an audiovisual system 1101 in accordance with the present disclosure. As shown, audio/visual system 1101 includes include at least one display 1102 and at least one speaker 1103. Control system 1104 is coupled to audiovisual system 1101 and apparatus 100, and controls the operation thereof. The at least one display 1102 may include may be a one or more televisions or movie screens, and may be configured so as to provide a user of apparatus 100 with a sense of virtual reality. For example, display 1102 may be configured so as to partially or completely surround a user of apparatus 100

In some embodiments, audio-visual system 1101 can be employed to provide a user of the apparatus described herein with a simulated experience of walking or running another location. For example, display 1102 may play back pre-recorded videos of a walk at one or more locations around the world, such as a famous beach or historical landmark. At the same time, speaker 1103 may output sounds consistent with the environment displayed on displays 1102. For example, if displays 1102 playback a recording of a walk on a famous beach, speaker 1103 may output sounds consistent with the beach location, such as waves crashing, seagulls chirping, etc. The video recordings played on displays 1102 may be filmed in first person from multiple angles. For example, displays 1102 of audio visual system 1101 may display side views of the ocean and inland areas, and/or perspective views of the entire beach in front. In some embodiments, audio visual system 1101 may also include at least one of full spectrum lighting, blue painted ceilings, fans, misting machines, other accoutrements, and combinations thereof, so as to enhance the effect of being in the displayed location.

In some instances, the recordings displayed on the audio visual system may be made from forward facing and side facing stereo sound enabled video recorders that are transported along the beach at an average walking speed, such as but not limited to about 1.2 m/s. Using the recording speed as a reference, the rate of video playback and the rotational speed of the primary endless belt may be synced, e.g., by control system 1104 or another means. Thus, for example, if the primary endless belt of apparatus 100 is rotating at a speed of 1.2 m/s, the video playback speed on audio visual system 1101 may remain at the default rate of 1.2 m/s. If the rotation of the primary endless belt increases 10% to 1.32 m/s, than the speed of the video playback may be similarly increased, thereby providing a user of the apparatus with a sensation of moving at increased speed on the terrain displayed on audio visual system 1101. Of course, the speed at which the recordings are made and speed of the primary endless belt may vary widely, e.g., anywhere from about 0.1 to about 1.6 m/s.

In many instances, the pitch (up/down), slope (left/right) and grade (even/irregular/uneven) of natural terrain is not consistent with a perfectly flat surface. Rather, natural terrain typically exhibits some degree of irregularity in pitch, slope, grade, and combinations thereof. In this case of beaches, for example, the terrain typically slopes downward from land towards a body of water.

In some embodiments the pitch and slope of the walking surface may be adjusted so as to simulate terrain of various pitch and grade. For example, the walking surface may vary in pitch from about −45 to about +45 degrees, such as about −30 to about +30 degrees, about −15 to about +15 degrees, about −10 to about +10 degrees, about −5 to about +5 degrees, 0 degrees, and all increments there between. Similarly, the slope of the walking surface may be adjusted between about −30 to about +30 degrees, such as about −15 to about +15 degrees, about −10 to about +10 degrees, about −5 to about +5 degrees, 0 degrees, and variations there between. With respect to pitch, negative degrees are used herein to indicate a decline, whereas positive degrees are used herein to indicate an incline. With respect to slope, negative degrees are used to indicate a leftward slope (relative to a user facing the front of apparatus 100), and positive degrees are used herein to indicate a rightward slope.

In some embodiments of the present disclosure, at least one of the pitch, slope, and grade of the walking surface of the apparatus described herein may be adjusted so as to simulate the pitch, slope, and grade of a natural surface. Thus, for example, at least one of the pitch, slope, and grade of the walking surface may be configured so as to simulate the corresponding properties of a natural or man-made beach. Thus, in some embodiments the slope of the walking surface ranges from about +/−1 to about +/−5 degrees.

The grade of the walking surface may be controlled by way of a screed, as described previously. As to the pitch and slope of the walking surface, such properties may be adjusted by pitching the walking surface up and down, and sloping it from side to side. Pitching of the walking surface may be achieved using mechanisms similar to those used to adjust the pitch of a conventional treadmill. For example, a manual, mechanical, pneumatic, hydraulic, or other displacement mechanism may be placed beneath the primary endless belt, and actuated to raise and lower the front end of such belt. Similarly, tilting of the walking surface may be achieved, for example, by lifting one side of the walking surface, e.g., with manual, mechanical, hydraulic, pneumatic, or other displacement mechanism placed underneath the primary endless belt. Alternatively or additionally, the walking surface may remain flat, but the screed may alter the left to right or right to left height of the sand by raising or lowering one of the sides of the grading plate.

In some embodiments of the present disclosure, the apparatus may be configured so as to permit a user to "turn around" on the terrain displayed on displays 1102 of audio visual system 1101. For example, a user of apparatus 100 may walk down a portion of a beach (or other terrain) simulated by the combination of apparatus 100 and audio/visual system 1101 for some time, and then "turn around" and begin to walk the opposite way, thereby creating a realistic walking experience. To facilitate this experience, the walking surface and/or support structure may be sloped a few degrees to simulate the user walking on a walking surface inclined from left to right or from right to left as user faces forward.

For example, the walking surface may be tilted left to right or right to left by about one to about twenty-five degrees, such as from about two to about fifteen degrees, or even from about three to about ten degrees. In some embodiments the walking surface may be tilted left to right or right to left by about four degrees. Then, upon instigation of a turn-around (e.g., by an input from control system 1108), the horizontal decline of the grading plate of the screed may switch, e.g., from right to left to left to right or vice versa. Subsequently or simultaneously, the audio/visual system may alter its display to simulate what one might see if they were turning around on the displayed terrain.

The ability to adjust the pitch, slope, and/or grade of the walking surface may also be used to adjust the workload imparted on a user of the apparatus described herein. Moreover, such features may facilitate analysis and/or correction of the gait of a user.

Another aspect of the present disclosure relates to methods and therapeutic uses of the apparatus described herein. As noted previously, the particulate material included in the walking surface can allow users to burn more calories per hour, relative to exercising on a traditional treadmill or a solid surface. In some instances, this increased caloric burn rate is true, even if a user walks or runs on the apparatus described herein at a lower speed than he/she would on a solid surface.

The increased caloric expenditure that can be achieved with some embodiments of the present disclosure can be useful to assist individuals whose ability to lose weight has been hindered in some fashion. For example, overweight or injured individuals, diabetics, and individuals who simply cannot run very fast can burn extra calories by using the apparatus described herein, with minimal risk of exacerbating injury.

Moreover, use of the apparatus described herein instead of a traditional treadmill may slow the progression of knee or hip osteoarthritis, due to the impact dissipating nature of the particulate material included in the walking surface. Indeed, some embodiments of the apparatus described herein offer the dual benefit of increased caloric expenditure and less cumulative impact loading of the knee and hip joints, relative to a traditional treadmill. Furthermore, exercise on the apparatus of the present disclosure may significantly reduce cumulative impact relative to exercise on a traditional treadmill, as the fewer steps per workout are required to achieve a desired caloric expenditure, and exercise may be conducted at lower speed.

Users of the apparatus described herein may also benefit by exposing their feet to the warm surface of the particulate material of the walking surface. Individuals with diabetes may find such exposure particularly useful, as such exposure may improve peripheral circulation, which in turn may improve other conditions of the diabetic foot. Moreover, because the temperature of the particulate material may be carefully controlled, such benefits may be realized without the risk of burning the feet. Further, because the particulate material of the walking surface may have force dissipating properties, contact of the feet with the particulate surface can allow a diabetic user to exercise with less danger of foot ulcerations.

The apparatus of the present disclosure can also be used as an aid to users suffering from plantar fasciitis. Indeed, such users may experience a therapeutic benefit (e.g., reduced pain, swelling, etc.) by contacting the affected area of the foot with the warm or hot particulate material of the walking surface. Further, walking or running on the dry particulate may serve as a strength and conditioning therapy that improves the health of the fascia of the foot.

Accordingly, another aspect of the present disclosure relates to methods of treatment that utilize the apparatus described herein. In some embodiments, the methods include contacting the extremities (i.e., the hands or feet) of a patient to the walking surface of the apparatus described herein. In some embodiments, the methods further include heating the particulate material to a temperature ranging from 40 degrees to about 200 degrees Fahrenheit, such as about 50 to about 180 degrees Fahrenheit, about 60 to about 160 degrees Fahrenheit, about 70 to about 140 degrees Fahrenheit, or even about 80 to about 125 degrees Fahrenheit, and exposing the extremities of a patient to the heated walking surface.

Exposing the extremities of a patient to the walking surface may include, for example, having the patient stand, walk, or otherwise move on the walking surface of the apparatus described herein. Exposure times may range from minutes to hours. For example, the methods may include exposing the extremities of a patient to the walking surface for about 1 minute to about 180 minutes, such as about 5 minutes to about 90 minutes, about 10 minutes to about 60 minutes, or even about 10 minutes to about 30 minutes.

In some embodiments of the present disclosure, exposing the extremities of a patient to the walking surface includes partially or completely immersing the patient's extremities (e.g., feet) in the particulate material of the walking surface. In such non-limiting embodiments, the depth of the walking surface is set so as to achieve the desired level of immersion. The full or partial immersion of the extremity in the heated particulate can result in a good transfer of heat energy from the particulate to the extremity.

During exposure, the speed of the primary endless belt may be set to an appropriate rate based on the condition of the patient and the exposure desired. For example, risk of foot injury may be of particular concern if the patient in question suffers from diabetes. In such instances, the speed of the primary endless belt may be maintained at a sufficiently low rate so as to lower or minimize the risk of injury to the patient's feet.

As noted above, exposing the extremities of a patient to the walking surface of the present disclosure is expected to impart a therapeutic benefit to patients suffering from a variety of conditions. As non-limiting examples of such conditions, mention is made of diabetes, plantar fasciitis, arthritis, peripheral neuropathy, and Reynaud's disease. Indeed, such conditions are expected to benefit from heat therapy resulting from exposure to the walking surface described herein, as such therapy can increase circulation, reduce pain, and/or reduce inflammation.

The present disclosure also envisions the combined use of partial body weight support ("PBWS") with the apparatus described herein. By combining these respective devices, new, more comprehensive therapies may be developed for individuals that have experienced spinal cord injury or another injury to the nervous system. In this regard, rhythmic contact of the feet with the ground is one mechanism that is thought to enhance recovery in individuals that have suffered a spinal cord injury.

In healthy individuals, contact with the ground in sensed by differentiated nerve cells with specific sensory apparatus at the terminus, which are embedded in the dermis of the skin. These sensory organs connect to the brain by transit up the spinal cord. The left hemisphere of the brain is in control of the right half of the body and likewise for the right hemisphere of the brain, which controls the left side of the body. In order to effect this side switching, the sensory nerve enters the spinal cord in the dorsal root, travels up the spinal cord and switches sides in the medulla. In this way a touch to the right toe travels to the brain along the right side of the spinal cord. In contrast, signals from undifferentiated "bare nerve endings," responsible for sensing temperature and pain, travel to the brain along the opposite side of the spinal cord as the stimulus after switching sides at the level of insertion at the dorsal root on the spinal cord. As such, a hot sensation on the right toe travels up the left side of the spinal cord.

The present disclosure envisions therapeutic methods for spinal cord injury patients that take advantage of the anatomically significant differences in how different types of stimuli are transmitted to the brain. Specifically, the present disclosure envisions methods wherein a patient suffering from spinal cord injury is supported by a PBWS above the walking surface of the apparatus described herein, such that their feet come into rhythmic contact with the walking surface. By heating the walking surface, the patient's feet may be exposed to two different stimuli (temperature, ground contact) at the same time. This is expected to excite both sides of spinal cord simultaneously, which may lead to increased patient recovery from spinal cord injury.

The ability of the walking surface to tilt from side to side may be leveraged by health care providers to understand and treat patients that suffer from conditions that have strong bilateral differences between an affected side of the body and a healthy side of the body. Non-limiting examples of such patients include those that have suffered a stroke, or who suffer from multiple sclerosis. For example, one side of the body of a stroke patient is often more severely affected than the other side. Such patients may benefit from walking on the apparatus described herein, particularly if the apparatus is tilted so as to impart a desired level of stress on the more severely affected side.

Other embodiments will be apparent to those skilled in the art from consideration of the specification and practice of the inventions disclosed herein. It is intended that the specification and examples be considered as exemplary only, with a true scope and spirit of the invention being indicated by the following claims.

What is claimed is:

1. An apparatus comprising:

at least two rollers;

a primary endless belt rotatably disposed about said at least two rollers, said primary endless belt comprising a primary endless belt surface, a primary endless belt rear end, and a primary endless belt front end;

a walking surface disposed on said primary endless belt surface, said walking surface comprising a layer of particulate material; and a return transport system operable to receive said particulate material proximate to said primary endless belt rear end and to deliver said particulate material to said primary endless belt surface at a position proximate to said primary endless belt front end.

2. The apparatus of claim 1, wherein said primary endless belt has a substantially U-shaped cross section.

3. The apparatus of claim 1, wherein said primary endless belt further comprises at least one primary endless belt sidewall.

4. The apparatus of claim 1, wherein said particulate material is selected from the group consisting of sand, rock, metal, rubber, quartz, limestone, polymer, silica and combinations thereof.

5. The apparatus of claim 1, further comprising a screed coupled to said treadmill at a position proximate to said primary endless belt front end and an upward facing portion of said primary endless belt surface.

6. The apparatus of claim 5, wherein said layer of particulate material has a depth and a distribution, and said screed is operable to control at least one of said depth and distribution of said layer of particulate material.

7. The apparatus of claim 5, wherein said screed comprises at least one of a screed plate, a prow, and a combination thereof.

8. The apparatus of claim 5, wherein said screed further comprises at least one heating element operable to adjust the temperature of said layer of particulate material.

9. The apparatus of claim 1, wherein said return transport system comprises an endless return belt that is at least partially disposed beneath said primary endless belt, said endless return belt comprising an endless return belt surface.

10. The apparatus of claim 9, wherein at least a portion of said endless return belt surface interacts with at least a portion of said primary endless belt surface to facilitate movement of said particulate material to an upward facing surface of said primary endless belt.

11. The apparatus of claim 9, wherein said endless return belt further comprises at least one endless return belt sidewall.

12. The apparatus of claim 11, wherein:

said primary endless belt comprises at least one primary endless belt sidewall; and said at least one endless return belt sidewall mates with at least a portion of said at least one primary endless belt sidewall.

13. The apparatus of claim 9, wherein said endless return belt further comprises at least one rib extending from said endless belt surface.

14. The apparatus of claim 13, wherein said at least one rib mates with at least a portion of said primary endless belt surface so as to facilitate movement of said particulate material to an upward facing portion of said primary endless belt.

15. The apparatus of claim 1, wherein said return transport system comprises at least one screw operable to transport said particulate material from a position proximate to said primary endless belt rear end to a position proximate to said primary endless belt front end.

16. The apparatus of claim 1 further comprising a collection device disposed at a position proximate to said primary endless belt rear end, wherein said collection device receives at least a portion of said particulate material from said primary endless belt.

17. The apparatus of claim 16, wherein said collection device comprises at least one heating element operable to control a temperature of said layer of particulate material.

18. A method, comprising:

exercising an animal on a treadmill, the treadmill comprising:

at least two rollers;

a primary endless belt rotatably disposed about said at least two rollers, said primary endless belt comprising a primary endless belt surface, a primary endless belt rear end, and a primary endless belt front end;

a walking surface disposed on said primary endless belt surface, said walking surface comprising a layer of particulate material; and a return transport system operable to receive said particulate material proximate to said primary endless belt rear end and to deliver said particulate material to said primary endless belt surface at a position proximate to said primary endless belt front end.

19. The method of claim 18, wherein said particulate material is selected from the group consisting of sand, rock, metal, rubber, quartz, limestone, polymer, silica and combinations thereof.

20. The method of claim 18, further comprising a screed coupled to said treadmill at a position proximate to said primary endless belt front end and an upward facing portion of said primary endless belt.

* * * * *